US010760441B2

(12) United States Patent
Lambert et al.

(10) Patent No.: US 10,760,441 B2
(45) Date of Patent: Sep. 1, 2020

(54) TURBINE FOR A TURBINE ENGINE

(71) Applicant: Safran Aircraft Engines, Paris (FR)

(72) Inventors: Olivier Arnaud Fabien Lambert, Moissy-Cramayel (FR); Franck Robert Drouet, Moissy-Cramayel (FR); Gaël Frédéric Claude Cyrille Evain, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 301 days.

(21) Appl. No.: 16/016,882

(22) Filed: Jun. 25, 2018

(65) Prior Publication Data

US 2019/0010818 A1 Jan. 10, 2019

(30) Foreign Application Priority Data

Jun. 26, 2017 (FR) ..... 17 55821

(51) Int. Cl.

| | |
|---|---|
| ***F01D 11/02*** | (2006.01) |
| ***F01D 25/24*** | (2006.01) |
| ***F01D 11/12*** | (2006.01) |
| ***F01D 5/22*** | (2006.01) |
| ***F01D 9/04*** | (2006.01) |

(52) U.S. Cl.

CPC ..... *F01D 11/02* (2013.01); *F01D 5/225* (2013.01); *F01D 9/04* (2013.01); *F01D 11/12* (2013.01); *F01D 11/122* (2013.01); *F01D 25/246* (2013.01); *F05D 2230/60* (2013.01); *F05D 2240/11* (2013.01)

(58) Field of Classification Search

CPC ..... F01D 11/02; F01D 11/12; F01D 11/122; F01D 9/04; F01D 25/246; F01D 5/225; F05D 2230/60; F05D 2240/11

See application file for complete search history.

(56) References Cited

U.S. PATENT DOCUMENTS

| | | | | |
|---|---|---|---|---|
| 3,867,060 | A | 2/1975 | Huber | |
| 5,653,579 | A * | 8/1997 | Glezer | F01D 5/225 415/173.1 |
| 6,036,437 | A * | 3/2000 | Wolfe | F01D 5/225 415/173.3 |
| 6,171,052 | B1 * | 1/2001 | Aschenbruck | F01D 11/10 415/173.1 |
| 8,807,927 | B2 * | 8/2014 | Babu | F01D 11/122 415/173.5 |
| 2004/0022626 | A1 * | 2/2004 | Burdgick | F01D 11/005 415/173.5 |
| 2008/0175706 | A1 | 7/2008 | Ikeda et al. | |
| 2015/0292347 | A1 | 10/2015 | Chouhan | |

FOREIGN PATENT DOCUMENTS

| | | |
|---|---|---|
| FR | 2 879 649 A1 | 6/2006 |

* cited by examiner

*Primary Examiner* — David E Sosnowski
*Assistant Examiner* — Danielle M. Christensen
(74) *Attorney, Agent, or Firm* — Blank Rome LLP

(57) ABSTRACT

The invention relates to a turbine for a turbine engine, having a stator and a rotor comprising a rotor wheel having vanes the radially external periphery of which comprises at least one lip which radially extends outwards, with sealing means radially extending about the vanes and comprising a ring. The radially external end of the lip cooperates with said ring so as to form a seal of the labyrinth type.

9 Claims, 5 Drawing Sheets

TURBINE FOR A TURBINE ENGINE

CROSS-REFERENCE TO RELATED APPLICATIONS

This application claims the benefit of French Patent Application No. 1755821, filed Jun. 26, 2017, the contents of which is incorporated by reference herein.

TECHNICAL FIELD

The present invention relates to a turbine for a turbine engine, more particularly for a turbojet engine or a turboprop engine of an aircraft, as well as a method for mounting such a turbine.

BACKGROUND

A turbine engine, specifically a twin-spool turbine engine, conventionally includes, in the downstream direction, a fan, a low-pressure compressor, a high-pressure compressor, a combustion chamber, a high-pressure turbine and a low-pressure turbine.

Conventionally, in the present application, "upstream" and "downstream" are defined relative to the direction of the air flow in the turbine engine. Conventionally, in the present application, "internal" and "external", "lower" and "higher" and "internal" and "external" are similarly defined radially relative to the axis of the turbine engine.

The low-pressure turbine of a turbine engine comprises a turbine shaft whereon several successive stages, each including an impeller and a guide vane are mounted. Each impeller comprises a disk, on the external periphery of which substantially radial blades are mounted, with the disks of the various impellers being coaxially connected together and to the driving shaft of the turbine rotor, using appropriate means. Each guide vane comprises an internal annular platform and an external annular platform between which substantially radial blades extend. The external platform of the guide vane comprises means for hooking and attaching on an external casing of the turbine. All the guide vanes form the stationary part of the engine called the stator.

The blades of each rotor wheel conventionally include lips at the radially external periphery thereof, and cooperate with a ring made of an abradable material so as to form sealing means of the labyrinth seal type.

Such a structure is known for instance from document FR 2 879 649.

In order to ensure high performances of the turbine engine, the clearances at the seals have to be checked and the leakage rate at the interface between the blade lips and the ring made of abradable material have to be limited.

Therefore the need exists for improving the efficiency of such labyrinth seals, while facilitating the mounting and the structure of the assembly.

The invention more particularly aims at providing a simple, efficient and cost-effective solution to this problem.

SUMMARY

For this purpose, the present invention relates to a turbine for a turbine engine, for instance a turbojet engine or a turboprop engine of an aircraft, having a stator and a rotor comprising a rotor wheel having vanes the radially external periphery of which comprises at least one lip which radially extends outwards, with sealing means radially extending about the vanes and comprising a sealing ring; with the radially external end of the lip cooperating with said sealing ring so as to form a seal of the labyrinth type, characterized in that said sealing ring comprises at least one first portion and one second portion axially offset relative to one another, with the first portion and/or the second portion defining a groove wherein the lip is inserted, with the first portion and/or the second portion each cooperating with at least one lip of the vanes axially located opposite said first and second portions, with the first portion comprising a first protruding zone engaged in a form-fitting manner in the axial direction into a first recessed zone of the second portion, with the stator comprising means for holding the first and second portions in position relative to the stator.

A first lip, which forms a seal of the labyrinth type with the groove walls is thus obtained, with said seal having a significant head loss, i.e. a substantially higher one than in the prior art solution. As a matter of fact, thanks to the mounting which is facilitated by the two-part structure of the ring, a first lip having a large radial dimension can be obtained, which is engaged into a groove having a large radial dimension too. Besides, the protruding and recessed zones are so configured as to engage with each other in the axial direction, which ensures sealing between the first and second portions of the sealing ring.

The above-mentioned assembling between the first and second portions is thus of the mortise-and-tenon joint type.

The means for holding same in position may comprise a stop for radially supporting the first portion and means for tightening the second portion against the stator, with the first portion being positioned upstream of the second portion.

Such characteristic makes it possible to facilitate the assembling of the ring on the stator.

The first portion can include a groove radially opening outwards and axially opening in the downstream direction, with the second portion including a groove radially opening outwards and axially opening in the upstream direction, opposite the groove of the first portion. The recesses of the first and second portions then form a groove.

In an alternative embodiment, only one of the first and second portions may comprise a recess, with the groove being defined by said recess and by one radial surface of the opposite portion.

The first portion may be radially held, upstream, by the stator, with the first portion being radially held, downstream, by the second portion.

The first portion and the second portion may comprise a block made of abradable material mounted on a support, with the first protruding and recessed zones of said first and second portions being formed on the supports.

The first portion and the second portion can be annular and consist of successive ring sectors, with each ring sector comprising slots at the circumferential ends thereof, with sealing tabs being mounted in said slots, between said sectors.

The first protruding zone and the first recessed zone can circumferentially extend over an angular range smaller than or substantially equal to the circumferential extension of one sector of the sealing ring. As mentioned above, the first protruding zone and the first recessed zone form a baffle which limits the rate of gas leakage flowing radially outwards in the jet, between the first and second portions. in order to optimize the efficiency of such baffle, same will preferably extend circumferentially on the whole or almost the whole of the circumferential extension of a sector of the ring. The above circumferential extension makes it possible to limit such leakage rate as much as possible.

The first portion, or the second portion respectively, can comprise a second protruding zone engaged in a form-fitting manner into a second recessed zone of the second portion, or the first portion respectively, with the first protruding and recessed zones being radially offset relative to the radially internal surface of the second protruding and recessed zones.

More particularly, the first protruding and recessed zones may be radially offset outwards relative to the second protruding and recessed zones.

The first protruding zone or the first recessed zone may be radially offset outwards relative to the second protruding zone or the second recessed zone.

Thanks to such axial shift, the baffle is larger in the axial direction, which optimizes the efficiency thereof by efficiently limiting the rate of gas leakage between the first portion and the second portion of the sealing ring.

The stator can comprise a turbine casing comprising an annular, for instance tapered wall, with at least one flange radially extending inwards from the annular wall of the turbine casing, with said flange axially bearing, upstream, on a radially external annular rim of the first portion, with said flange axially bearing, downstream, on a radially external annular rim of the second portion.

Said rims may be formed in the supports of the first and second portions.

The stator may comprise a downstream guide vane, with the downstream end of the second portion being engaged into a groove of the downstream guide vane.

The flange of the turbine casing may also be engaged into the groove of the downstream guide vane.

Each protruding zone may be attached to the first portion or to the second portion, at the base thereof, and may comprise a free end opposite the base. The first protruding zone may belong to the first portion, or to the second portion, respectively, with the second protruding zone possibly belonging to the second portion, or to the first portion, respectively. In this case, the free end of the first protruding zone may be axially offset relative to the base of the second protruding zone. Besides, the free end of the second protruding zone may be axially offset relative to the base of the first protruding zone. The base of the first protruding zone may be placed axially opposite the base of the second protruding zone.

The block made of abradable material of the first portion may comprise a radial downstream surface. The block made of abradable material of the second portion may comprise a radial upstream surface. The blocks made of abradable material of the first and second portions may be in mutual contact through their radial downstream and upstream surfaces.

The base of the second protruding zone may be axially offset, for instance in the downstream direction, relative to the downstream surface of the block of the first portion and/or relative to the upstream surface of the block of the second portion.

The first portion and/or the second portion comprise a radially external surface intended to support the flange of the casing.

Said external bearing surface comprises at least one annular groove. The contact area between the flange of the casing and the first and second portions is thus limited, so as to ensure a correct positioning.

The portion may comprise an attachment member, for instance having a U-shaped section, engaged in a form-fitting manner on the stator. The attachment member may be attached to the support of the first portion.

Each blade of the rotor wheel may comprise at least one first lip and one second lip, with the first lip extending radially outwards, beyond the second lip. The first lip may be engaged into the groove defined by the first and second portions. The second lips may cooperate with cylindrical or tapered radially internal surfaces of the first and second, portions.

The invention also relates to a method for assembling a turbine of the above-mentioned type, characterised in that it includes the following steps:

(a) mounting the first portion on a casing of the turbine, through an axial engagement in the upstream direction of said first portion relative to the casing, (b) mounting the rotor wheel in the casing, (c) mounting the second portion on the first portion, through an axial engagement in the upstream direction of said second portion relative to the first portion, with the lip being introduced into the groove during step (b) and/or step (c).

BRIEF DESCRIPTION OF THE FIGURES

The invention will be better understood and other details, characteristics, and advantages of the invention will appear on reading the following description given by way of non-limiting example and with reference to the accompanying drawings, in which.

DETAILED DESCRIPTION

Figure 1:
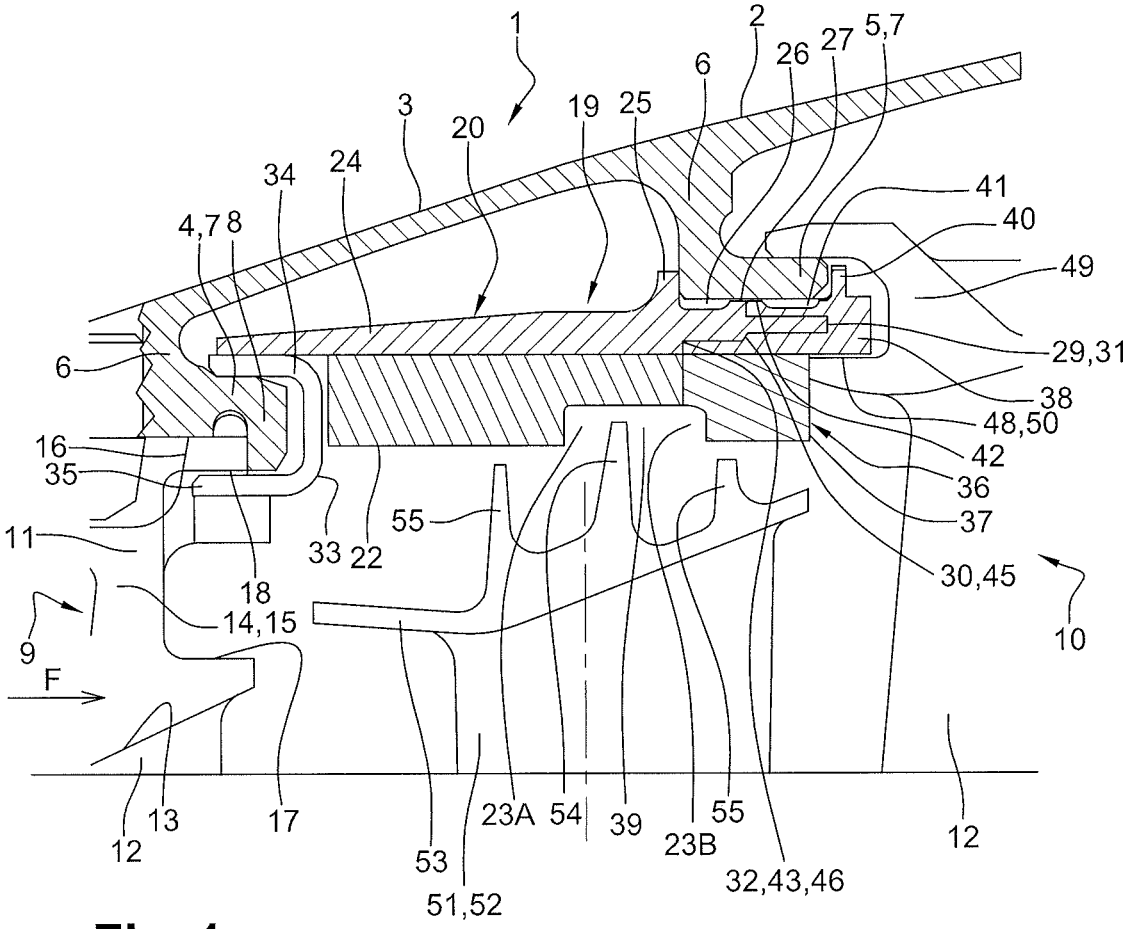
FIG. 1 is an axial view in perspective of a portion of a turbine according to one embodiment of the invention.

A low-pressure turbine 1 of a turbine engine according to a first embodiment is shown in FIG. 1. The turbine 1 includes a stationary casing 2, having a tapered wall 3, the axis of which matches the axis of the turbine engine and from which flanges 4, 5, radially extend inwards. The casing 2 more particularly includes an upstream flange 4, and a downstream flange 5. Upstream and downstream are defined relative to the direction F of the gas flow inside the turbine 1, i.e. from left to right in FIG. 1.

Each flange 4, 5, includes a first annular portion 6 which extends radially inwards from the tapered wall 3, and a second cylindrical portion 7 which extends in the downstream direction.

The upstream flange 4 further includes an annular radial rim 8 which extends radially inwards from the downstream end of the second portion 7.

The stator of the turbine 1 specifically includes two stages of guide vanes, which will be respectively referred to as the upstream guide vane 9 and the downstream guide vane 10, with each guide vane 9, 10 including a radially internal platform (not visible), a radially external platform 11*a*, 11*b* and stationary blades 12*a*, 12*b* connecting said platforms.

The external platform 11*a* of the upstream guide vane 9 includes a globally tapered wall 13, the downstream end of which comprises a bearing area 14 including a first portion 15 which extends radially outwards and a second portion 16 which extends axially in the downstream direction.

The downstream end of the second portion 16 of the bearing area 14 axially bears onto the rim 8 of the upstream flange 4 of the casing 2, with the second portion 16 of the bearing area 14 further bearing onto the second portion 7 of the upstream flange 4.

The upstream end of the external platform 11 of the downstream guide vane 10 includes a radially internal rim 17, and a radially external rim 18 which axially extend in the upstream direction, which are radially separated from each other. The radially internal rim 18 radially bears onto the radially external surface of the second portion 7 of the downstream flange 5. The function of the radially internal rim 17 will be described in greater details hereunder.

Figure 2:
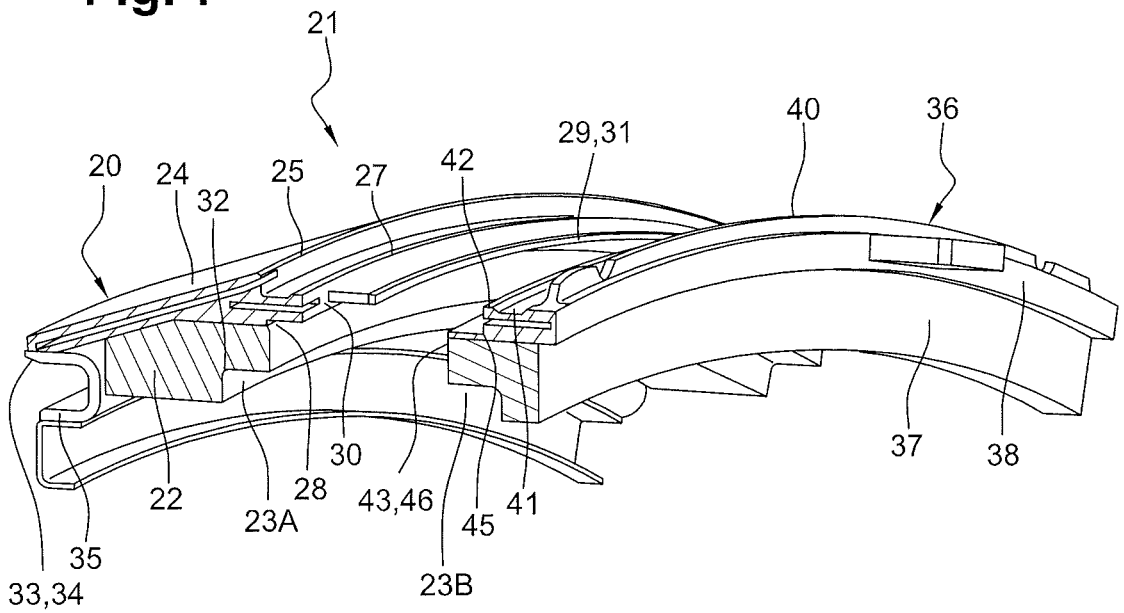
FIGS. 2 to 4 are exploded views in perspective of a part of the turbine according to the invention.
Figure 3:
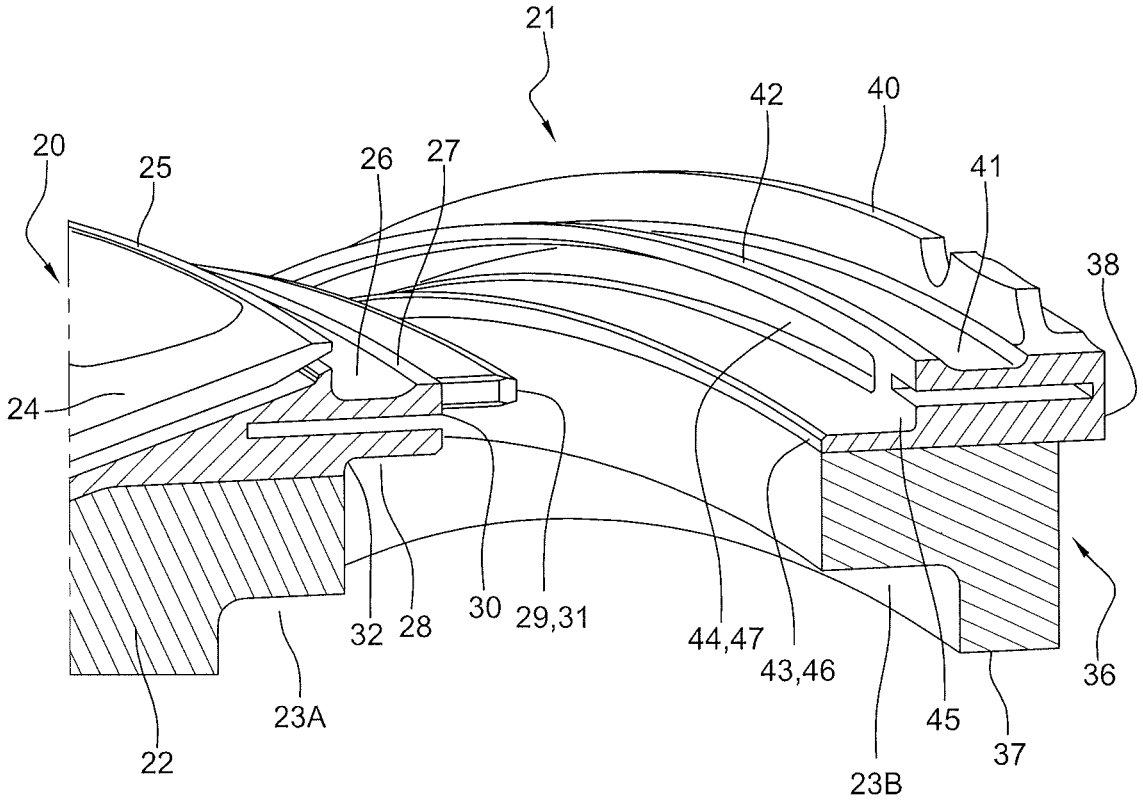
Figure 4:
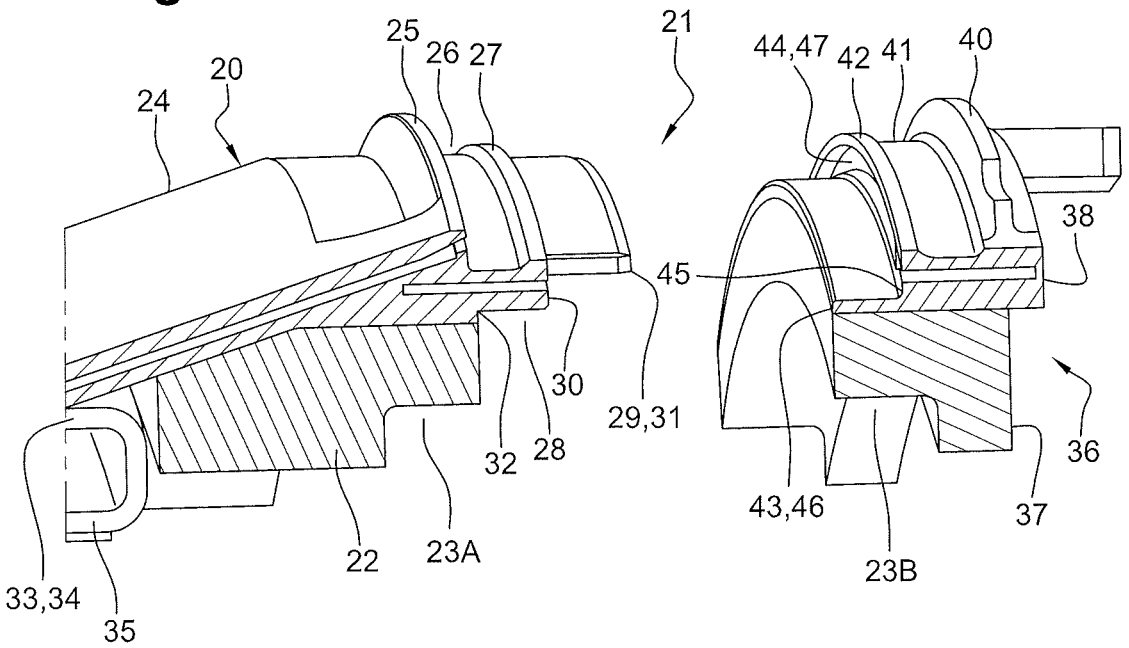
Figure 5:
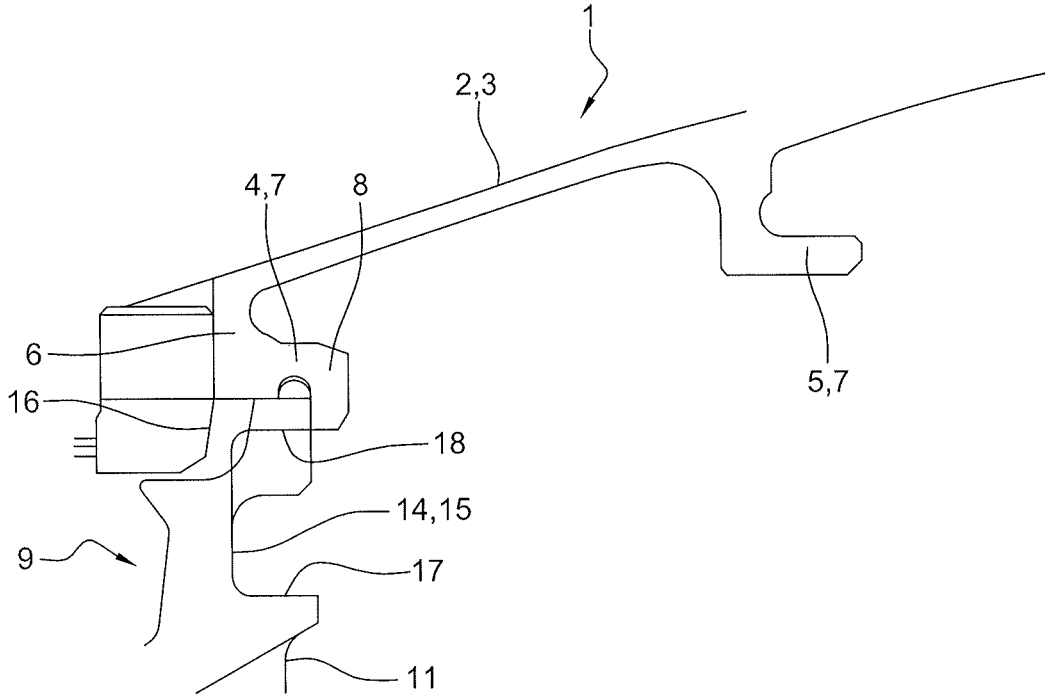
FIGS. 5 to 9 are views in axial section of a part of the turbine, which illustrates the successive steps of the assembling method according to the invention.
Figure 6:
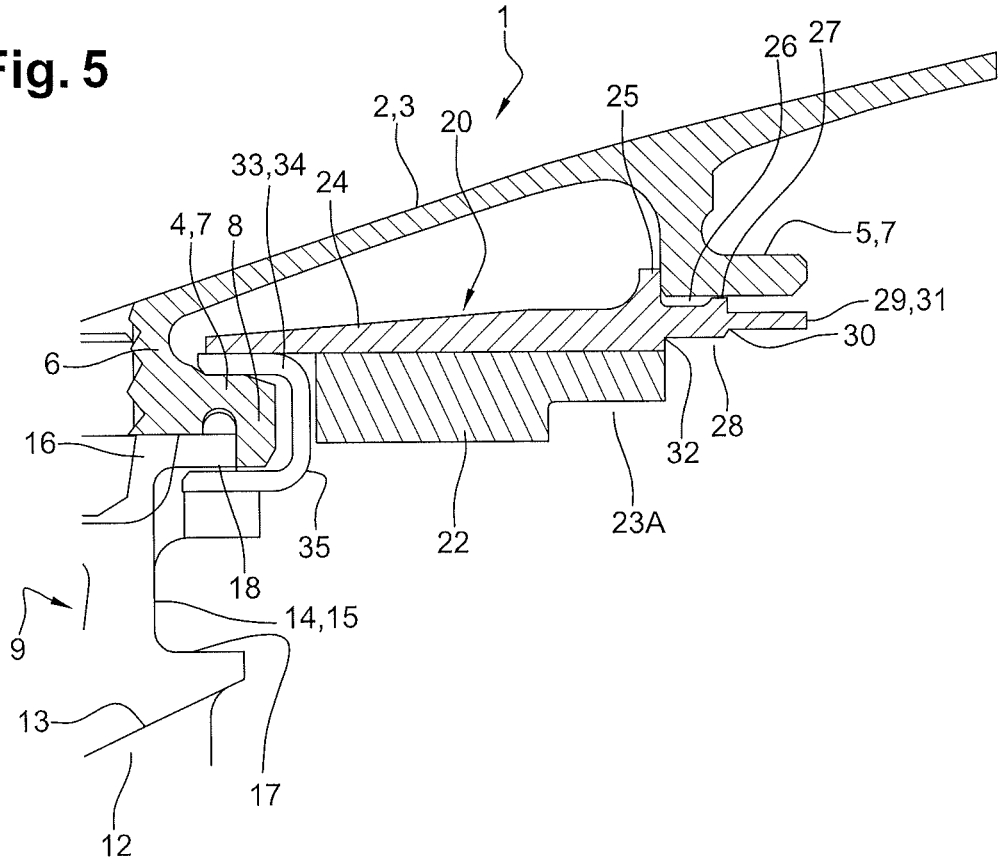
Figure 7:
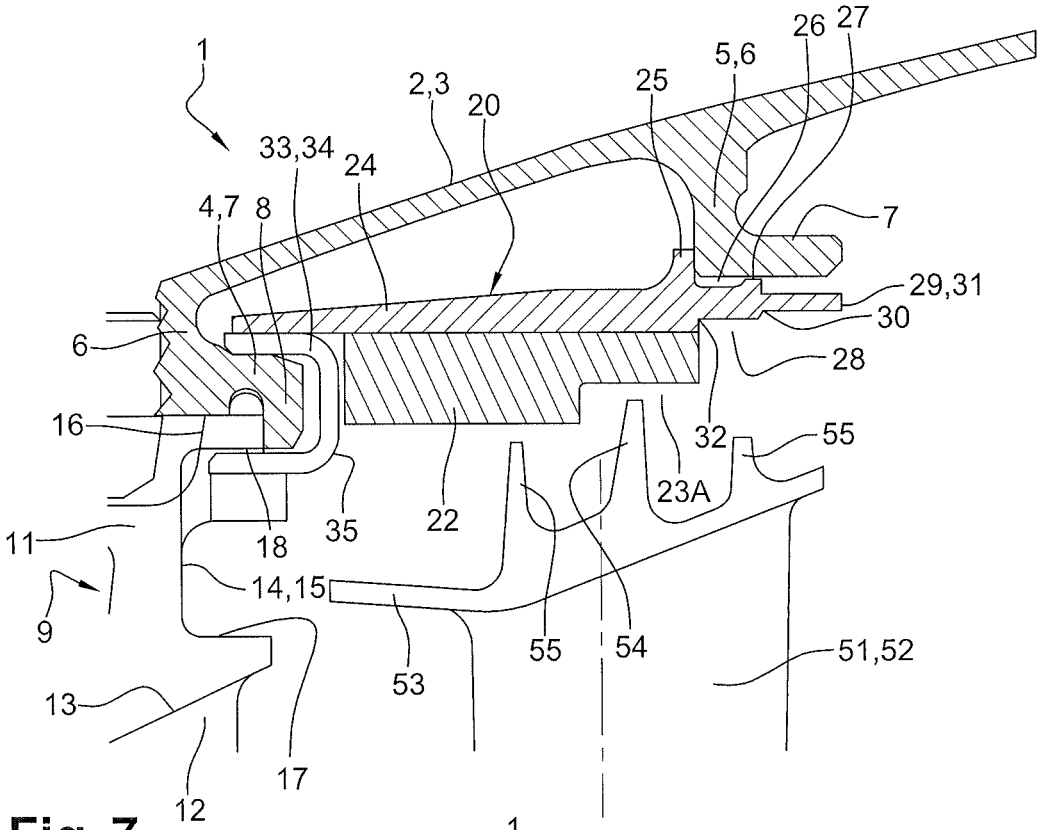

The turbine 1 further includes a sealing ring 19 rigidly mounted on the casing 2 and formed in two portions 20, 36, i.e. an upstream portion 20 and a downstream portion 36. The sealing ring 19 consists of several contiguous angular sectors 21 on the whole circumference, which are also shown in FIGS. 2 to 4.

The upstream portion 20 specifically includes an upstream block 22 made of abradable material, having an annular shape. The upstream block 22 includes a recess 23A at the downstream end thereof, with said recess 23A opening radially inwards and axially in the downstream direction.

The external surface of the upstream block 22 is attached to an upstream support 24, having an annular shape. The upstream support and the upstream block are then divided into sectors. The downstream support 24 comprises a rim 25 located in a median zone of the support 24 and radially extending outwards. The rim is able to axially bear on the downstream flange of the casing.

The radially external surface of the upstream support 24 further comprises an annular groove 26 directly located downstream of the rim 25. The downstream end of the upstream support 24 forms an annular bearing zone 27 having a limited surface, able to radially bear on the downstream flange 5 of the casing 2.

The upstream support 24 comprises a recessed zone 28 on its radially internal portion, with said recessed zone 28 opening radially inwards and axially in the downstream direction.

The upstream support 24 further comprises a protruding zone 29 which axially extends in the downstream direction and circumferentially extends on almost the whole sector 21 concerned.

The protruding zone 29 comprises a base 30 located upstream and a free end 31 opposite the base, located downstream.

The protruding zone 29 is radially offset outwards relative to the recessed zone 28. Besides, the base 30 of the protruding zone 29 is axially offset in the downstream direction relative to the upstream end 32 of the recessed zone 28.

An annular attachment member 33 with a U-shaped section, is attached at the upstream end of the upstream support 24 radially inside said upstream support 24. Said upstream attachment member 33 includes a radially external branch 34, able to radially bear onto the external surface of the second portion 7 of the upstream flange 4, and a radially internal branch 35 able to radially bear onto the second portion 16 of the bearing area 15 and onto the rim of the upstream support 4. A radial mounting clearance can be provided for.

The upstream guide vane 9 is thus attached to the upstream flange 4 through said upstream attachment member 33. Such member 33 also makes it possible to attach the upstream support 24 on the upstream flange 4.

The downstream part 36 specifically includes a downstream block 37 made of abradable material, having an annular shape. The downstream block 37 includes a recess 23B at the upstream end thereof, with said recess 23B opening radially inwards and axially in the upstream direction. The recesses 23A, 23B of the upstream 22 and downstream 37 blocks define a groove 39.

The external surface of the downstream block 37 is attached to a downstream support 38, having an annular shape.

The downstream support 38 and the downstream block 37 are then divided into sectors. The downstream support 38 comprises a rim 40 located in a downstream zone of the support 38 and radially extending outwards. The rim 40 is able to axially bear on the downstream flange 5 of the casing 2.

The radially external surface of the downstream support 38 further comprises an annular groove 41 located upstream of the rim 40. The upstream zone of the downstream support 38 forms two annular bearing zones 42 having limited surfaces and axially located on either side of the groove 41. Said bearing zones 42 are able to radially bear on the downstream flange 5 of the casing 2.

The downstream support 38 comprises a protruding zone 43 on its radially internal portion, with said protruding zone 43 axially extending in the upstream direction and being engaged in a form-fitting manner into the recessed zone 28 of the upstream support 24.

The downstream support 38 further comprises a recessed zone 44 which circumferentially extends on almost the whole sector 21 concerned. The protruding zone 29 of the upstream support 24 is engaged in a form-fitting manner into the recessed zone 44 of the downstream support 38.

The protruding zone 43 of the downstream support 38 comprises a base 45 located downstream and a free end 46 opposite the base 45, located upstream.

The protruding zone 43 is radially offset inwards relative to the recessed zone 44. Besides, the base 45 of the protruding zone 43 is axially offset in the upstream direction relative to the downstream end of the recessed zone 47.

Besides, the downstream support 38 radially bears on the radially external surface 48 of the internal rim 17 of the external platform 11*b* of the downstream guide vane 10. The downstream block 37 axially bears on the upstream radial surface of the internal rim 17 of the external platform 11*b* of the downstream guide vane 10.

The turbine 1 further includes a rotor wheel 51 including vanes 52, with the radially external periphery 53 of each vane 52 including a first, axially central, lip 54 and two second lips 55 axially offset on either side of the first lip 54. The first and second lips 54, 55 extend radially outwards, with the first lip 54 extending radially outwards relative to the second lips 55. The first lip 54 is engaged into the recesses 23A, 23B of the upstream and downstream portions 20, 36 of the ring 19. The second lips 55 extend opposite the radially internal surfaces of the upstream and downstream blocks 22, 37.

The cumulative axial dimension of the recesses 23A, 23B, i.e. the axial dimension of the groove 39, enables a displacement or an uncertain axial positioning of the rotor wheel 51, and thus of the first lip 54, relative to the casing 2, with such uncertainty possibly resulting from the manufacturing and mounting tolerances as well as from the mechanical and/or thermal constraints in operation.

The mounting of the turbine 1 will now be described while referring to FIGS. 5 to 9.

The upstream guide vane 9 is first mounted inside the casing 2 (FIG. 5), the upstream portion 20 of the ring 19 is then axially engaged in the upstream direction into the casing 2 (FIG. 6), on the upstream flange 4 of the casing 2.

Figure 8:
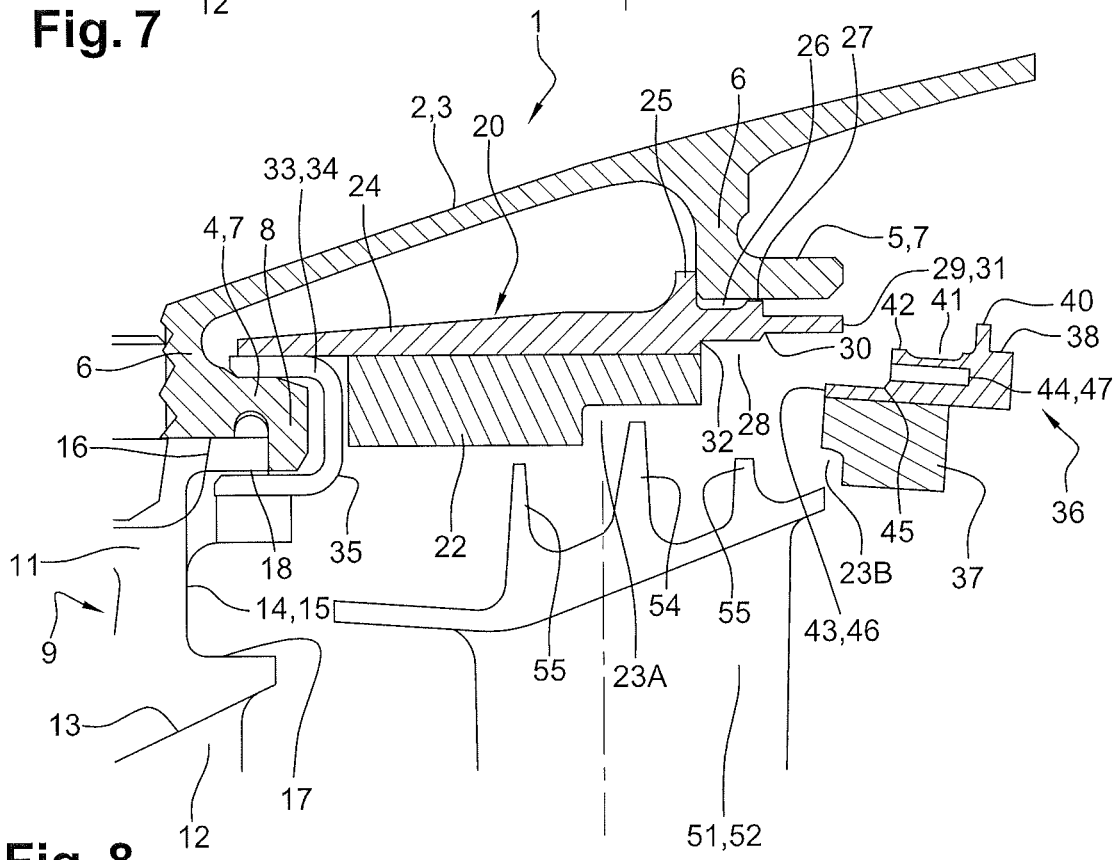
Figure 9:
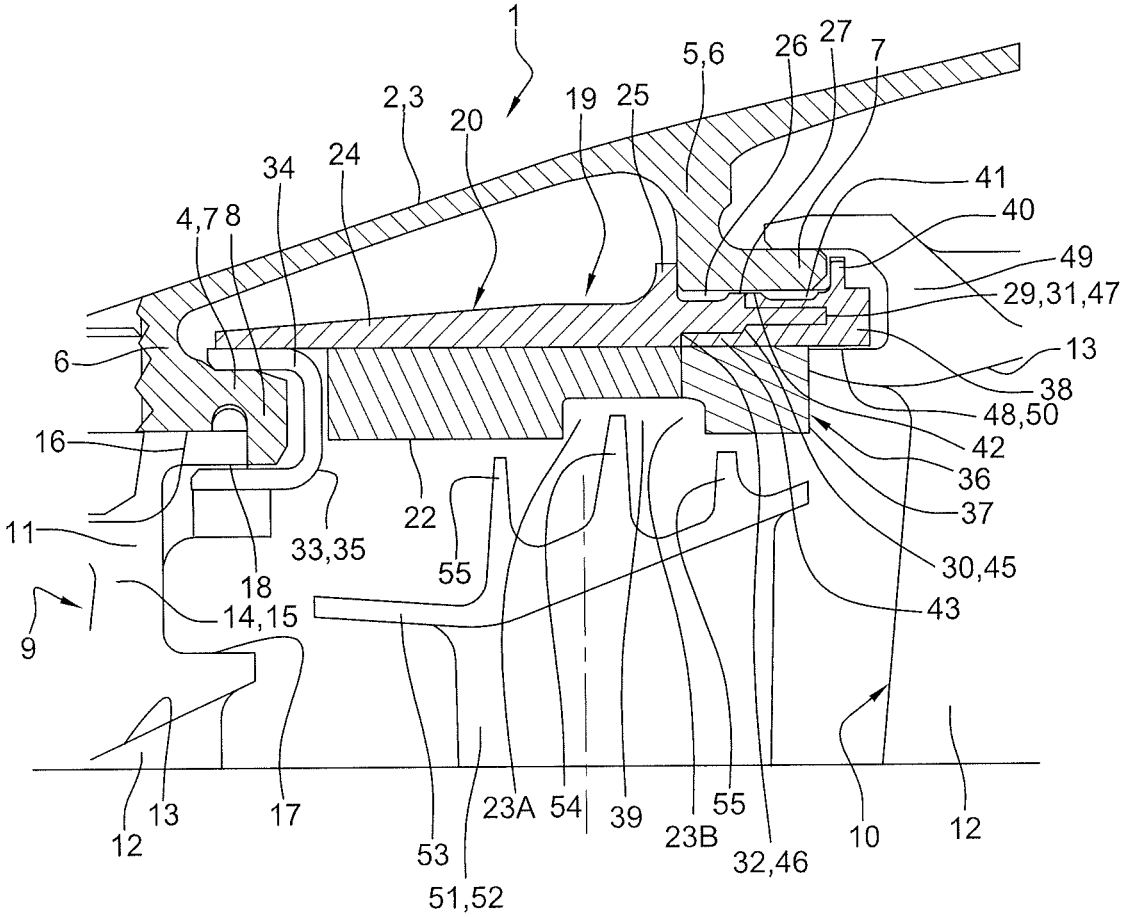

The upstream attachment member 33 is engaged in the upstream flange 4 and in the part 16 of the upstream guide vane 9 so as to provide the attachment of the upstream guide vane 9 on the upstream flange 4. The rotor wheel 51 including the vanes 52 is then axially engaged into the casing 2, in the upstream direction (FIG. 7), with the first lip 54 being, at least partially, positioned in the recess 23A of the upstream abradable block 22. The downstream portion 36 of the ring 19 is then axially engaged into the casing 2, in the upstream direction, so that the protruding 29 and recessed 28 zones of the upstream portion can engage, in a form-fitting manner, into the recessed 44 and protruding 43 zones of the downstream portion 36 (FIG. 8). The downstream portion 36 is thus attached to the upstream portion 20.

The downstream guide vane 10 is then axially engaged into the casing 2, in the upstream direction (FIG. 10). The rim 17 of the external platform 11 of the downstream guide vane 10 radially bears onto the downstream flange 5. The internal rim 17 of the external platform 11*b* of the downstream guide vane 10 radially bears onto the radially internal surface of the downstream support 38 and axially bears on the downstream block 37, as mentioned above. The downstream support 38 thus bears onto the downstream flange 6 of the casing 2, using the downstream guide vane 10.

The invention claimed is:

1. A turbine for a turbine engine, the turbine having a stator and a rotor comprising a rotor wheel having vanes the radially external periphery of which comprises at least one lip which radially extends outwards, with sealing means radially extending about the vanes and comprising a sealing ring; with the radially external end of the lip cooperating with said sealing ring so as to form a seal of the labyrinth type, wherein said sealing ring comprises at least one first portion and one second portion radially offset relative to one another, with the first portion and/or the second portion defining a groove wherein the lip is inserted, with the first portion and/or the second portion each cooperating with at least one lip of the vanes axially located opposite said first and second portions, with the first portion comprising a first protruding zone engaged in a form-fitting manner in the axial direction into a first recessed zone of the second portion, with the stator comprising means for holding the first and second portions in position relative to the stator, wherein the position-holding means comprise a stop for radially bearing the first portion and means for tightening the second portion against the stator, with the first portion being positioned upstream of the second portion.

2. The turbine according to claim 1, wherein the first portion is radially held, upstream, by the stator, with the first portion being radially held, downstream, by the second portion.

3. The turbine according to claim 1, wherein the first portion and the second portion are annular and consist of successive ring sectors, with each ring sector comprising slots at the circumferential ends thereof, with sealing tabs being mounted in said slots, between said sectors.

4. The turbine according to claim 1, wherein the first protruding zone and the first recessed zone circumferentially extend over an angular range smaller than or substantially equal to the circumferential extension of one sector of the sealing ring.

5. The turbine according to claim 1, wherein the first portion, or the second portion respectively, comprises a second protruding zone engaged in a form-fitting manner into a second recessed zone of the second portion, or the first portion respectively, with the radially internal surface of the first protruding and recessed zones being radially offset relative to the radially internal surface of the second protruding and recessed zones.

6. The turbine according to claim 5, wherein the first protruding zone or the first recessed zone are axially offset relative to the second protruding zone or the second recessed zone.

7. The turbine according to claim 1, wherein the stator comprise a turbine casing comprising an annular wall, with at least one flange radially extending inwards from the annular wall of the turbine casing, with said flange axially bearing, upstream, on a radially external annular rim of the first portion, with said flange axially bearing, downstream, on a radially external annular rim of the second portion.

8. The turbine according to claim 1, wherein the stator comprises a downstream guide vane, with the downstream end of the second portion being engaged in a groove of the downstream guide vane.

9. A method for assembling the turbine according to claim 1, the method comprising the following steps:

(a) mounting the first portion on a casing of the turbine, through an axial engagement in the upstream direction of said first portion relative to the casing, (b) mounting the rotor wheel in the casing, and (c) mounting the second portion on the first portion, through an axial engagement in the upstream direction of said second portion relative to the first portion, with the lip being introduced into the groove during step and/or step.

* * * * *